US007549640B1

(12) United States Patent
Evans et al.

(10) Patent No.: US 7,549,640 B1
(45) Date of Patent: Jun. 23, 2009

(54) BOARD GAME

(76) Inventors: Lenworth N. Evans, 1642 E. Greeleaf St., Allentown, PA (US) 18190; Phillip Jones, 1642 E. Greenleaf St., Allentown, PA (US) 18190

( * ) Notice: Subject to any disclaimer, the term of this patent is extended or adjusted under 35 U.S.C. 154(b) by 44 days.

(21) Appl. No.: 11/739,469

(22) Filed: Apr. 24, 2007

(51) Int. Cl.
*A63F 3/00* (2006.01)

(52) U.S. Cl. ..... 273/243; 273/263

(58) Field of Classification Search ..... 273/248, 273/249, 263, 271, 268, 242, 243
See application file for complete search history.

(56) References Cited

U.S. PATENT DOCUMENTS

| | | | | |
|---|---|---|---|---|
| 796,774 | A * | 8/1905 | Thompson | 273/255 |
| 1,362,218 | A * | 12/1920 | Beloin | 273/249 |
| 3,650,534 | A * | 3/1972 | Collett | 273/239 |
| 3,894,738 | A | 7/1975 | Dykes, Jr. et al. | |
| 4,049,275 | A | 9/1977 | Skelton | |
| 4,139,199 | A | 2/1979 | Drummond | |
| 5,261,671 | A | 11/1993 | Wyatt | |
| D357,711 | S | 4/1995 | Buffone | |
| 6,926,278 | B2 * | 8/2005 | Bibi | 273/284 |
| 2003/0218301 | A1 | 11/2003 | Gonzalez | |

* cited by examiner

*Primary Examiner*—Vishu K. Mendiratta
(74) *Attorney, Agent, or Firm*—Crossley Patent Law; Mark Ashley Crossley

(57) ABSTRACT

A board game of chance and skill using a game board, a pair of dice, and tokens. The player throwing the highest initial roll begins game play. Rolling one six or two sixes allows movement of one token or two tokens, respectively, from a home base space marked with a country name to a starting space marked "GATE" and along a clockwise path of movement to a finish space marked "PARADISE". A token is returned to home base space if another player's token lands on the same game space. A blockade, which may not be passed by other players' tokens until such blockade is broken, is created when two tokens of one player are placed on the same game space. An exact roll is required to enter a finish space. The first player with all tokens in his finish space is the winner.

1 Claim, 4 Drawing Sheets

| LUDO GAME RULES |
| --- |
| This game can be played with 2 to 4 players. |
| This game can be played with one or two dice. Each player has 4 tokens. |
| Every player must roll the dice to determine who plays first. Player with the highest roll starts. |
| A token cannot leave the starting area until a six is thrown on one die. If double six is thrown that player can move 2 tokens out of the start area. After the token is out of the gate then you can use other throws to move it. |
| Players move clockwise around the board by rolling dice. The results of the dice roll can be divided among one or two tokens. |
| A token can be sent back to home base when an enemy piece lands on it. You cannot put a token back home if it has a barrier (two tokens or more) on that space. |
| A player can only pass a barrier if it is his own. A barrier can be anywhere on the board. If a player has all 4 tokens behind an enemy barrier and there is no more space, that player has no more moves until the barrier is broken. |
| When a player is near home, the middle row of squares is used to get to home base (triangle area). You must roll the exact amount needed to get to the home base. The first player to get all four tokens home is the winner. |
| After the first winner, the rest of the players have the option of continuing to play. |

FIG. 4

BOARD GAME

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of board games are known in the prior art. Prior art patents disclose games designed to entertain players and provide friendly competition among players. For example, U.S. Patent Application No. 2003/0218301 filed by Gonzalez and published on Nov. 27, 2003 teaches a board game used for playing a bicycle or tour race with an improved game board. The game board includes indicia thereon which defines a plurality of parallel tracks which extend along an interior periphery of the game board, the tracks extending around the entire game board. At least a section of the parallel tracks pass through indicia on the game board defining a geographic area which includes indicia defining sites and places of interest within the geographic area defined. Overlay strips, defining other geographic areas with sites and places of interest within the other geographic area are provided, for changing the geographic area on the game board. The board includes a set of receiving and retaining slots for receiving and retaining overlay strips for changing the geographic area through which the tracks of the race pass.

U.S. Pat. No. 3,894,738 issued to Dykes, Jr. et al. on Jul. 15, 1975 teaches a new and improved game for entertainment and educational purposes where players evaluate and assess relative risks and merits of alternative paths of movement from a starting location to a home base position during play of the game. Playing tokens assigned to the players move from the starting location to the home base position in a sequence of numbers of moves specified in a random sequence by a play determining means. The players may move their playing tokens along alternate travel paths which have different numbers of movement steps, but the probability of occurrence in the play determining means of the lesser number of moves is less than that of the higher number of moves so that the players must evaluate and assess the relative risks and merits of movement along the alternate travel paths.

U.S. Pat. No. 4,049,275 issued to Skelton on Sep. 20, 1977 provides a board game apparatus for use in a game of chance which includes a game board having a playing surface characterized by a flat area with outer and inner tracks for traversal by a player or game token according to the throws of dice. The game tokens are magnetically influenced and successful traversal of the game tokens depends in part on chance expulsion from selected track positions by a magnet-equipped stick in the possession of each player.

U.S. Pat. No. 4,139,199 issued to Drummond on Feb. 13, 1979 teaches a game board having a grid thereon; numbers representing possible totals of a pair of dice sequentially designating grid spaces around the outer edges of the board; designated doubles grid spaces adjacent to the outer spaces containing numbers that can be obtained by doubling another number; and a series of central grid spaces that are arranged to be intercepts of other rows of spaces.

U.S. Pat. No. 5,261,671 issued to Wyatt on Nov. 16, 1993 teaches a board game includes (a) on a playing board a series of lettered boxes arranged as a playing course between START and FINISH boxes, and (b) a key which relates the indicia (e.g. numerals, colours, or pictures) appearing on the respective faces of a die to respective categories of things, objects, people, features, etc. The rules of the game require that a player's token standing on a given box can move to the next box only when the player has thrown the die, consulted the key to determine therefrom the category related to the number, colour, picture, or other indicium on the die face which is upwardly exposed by the throw of the die, and named a specific variety within that category, which variety has a name beginning with the letter of the box on which the player's token is currently standing.

U.S. Pat. No. D357,711 issued to Buffone on Apr. 25, 1995 teaches an ornamental design for a world game board.

The primary objects of the present board game are to provide a new and improved board game of chance and skill which entertains and provides friendly competition.

FIELD OF THE INVENTION

The present invention relates to games, and more particularly, to a new and improved board game of skill and chance which is designed to entertain and to provide friendly competition.

SUMMARY OF THE INVENTION

In view of the aforestated known types of board games now present in the prior art, the general purpose of the present board game, described subsequently in greater detail, is to provide a board game which has many novel features that result in a board game which is not anticipated, rendered obvious, suggested, or even implied by prior art, either alone or in combination thereof.

To accomplish this, the present board game provides four home base spaces in which the names of countries, such as USA, Canada, Jamaica, and England, are imprinted; a starting space adjacent to and to the right of each home base space; a plurality of sequential game spaces; six home path spaces, a triangular finish space imprinted with the word "Paradise" corresponding to a starting space; a pair of dice; and a plurality of tokens. At the beginning of each game, each player places his or her tokens on a starting space. Each player casts the dice and the player with the highest roll begins the game first by rolling the dice. A player may move a token forward to his starting space only upon rolling a six on one die. If a player rolls a six on two dice, the player may move two tokens forward to his starting space. The next players roll the dice in turn. After a player has a token in a starting space, each time said player rolls the dice he moves a token forward, in a clockwise direction, the number of game spaces equal to the throw of the dice. A single token may be returned to a player's home base space if another player's token lands on the same space occupied by the single token. Two of the same player's tokens landing on the same start space or game space creates a blockade which may not be passed by another player's token. In this instance, the two tokens are not returned to the home base space. A player may forward his tokens past a blockade such player created himself. When all of a player's tokens are behind a different player's blockade, such player may not advance any of his tokens until the blockade is broken. When a player's token initially enters any of such player's home path space, such player must roll the exact count to enter such player's finish space. The first player who places all four of such player's tokens into such player's finish space is declared the winner of the game. After a first player is declared to be the winner, all remaining players may continue to play the game as desired to declare a second-place winner and a third-place winner.

The instant board game may be played an unlimited number of times by two to four players and players of a variety of ages. The lightweight and portable board game can be easily transported to and played at almost any location. The limited number of parts simplifies storage of the present board game. The board game is compact for storage in limited space. The present board game is made of typical materials known in the art.

An object of the present board game is to provide an entertainment.

Another object of the present board game is to provide friendly competition.

Yet another object of the present board game is to provide a game of chance and skill.

Still another object of the present board game is to provide a game which may be played by two to four players.

Even still another object of the present board game is to provide a game which may be played by players of wide range of ages.

Even yet another object of the present game is to provide a board game which may be played in a wide variety of settings.

It is yet a further object of the present board game to provide a game, the rules for which are easy to learn.

It is yet even a further object of the present board game to provide a game which is portable and compact for storage in small storage spaces.

Thus has been broadly outlined the more important features of the present board game and method so that the detailed description thereof that follows may be better understood and in order that the present contribution to the art may be better appreciated.

Numerous objects, features and advantages of the present board game will be readily apparent to those of ordinary skill in the art upon reading the following detailed description of presently preferred, but nonetheless illustrative, examples of the present board game and method when taken in conjunction with the accompanying drawings. In this respect, before explaining the current examples of the present board game and method in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the board game and method. It is therefore important that the claims be regarded as including such equivalent constructions insofar as they do not depart from the spirit and scope of the present invention.

Objects of the present board game and method, along with various novel features that characterize the invention are particularly pointed out in the claims forming a part of this disclosure. For better understanding of the board game and method, its operating advantages and specific objects attained by its uses, refer to the accompanying drawings and description.

BRIEF DESCRIPTION OF THE DRAWINGS

Figures

FIG. 4 is a set of rules for playing the present board game

DETAILED DESCRIPTION OF THE DRAWINGS

Figure 1:
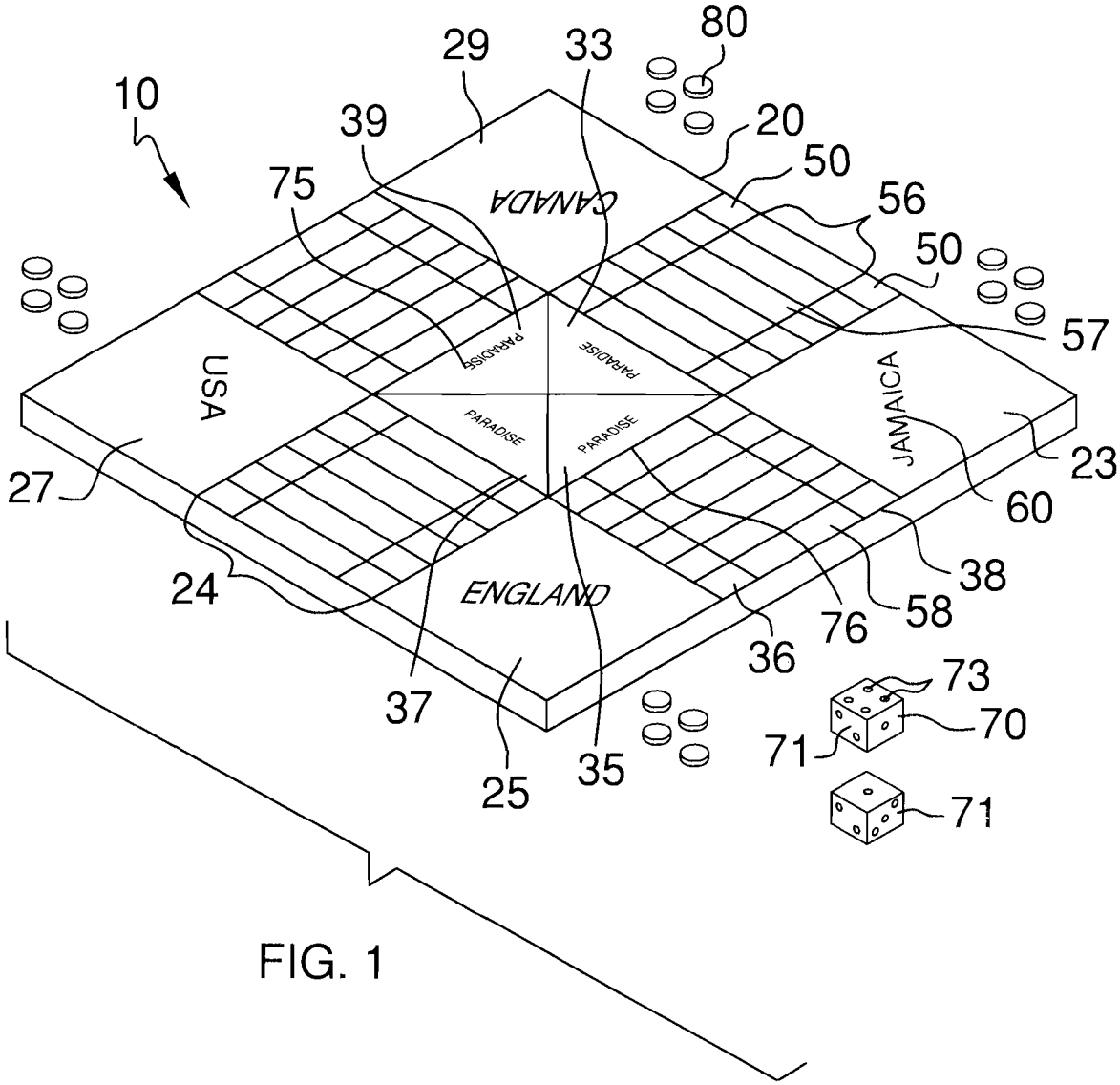
FIG. 1 is an isometric view.
Figure 2:
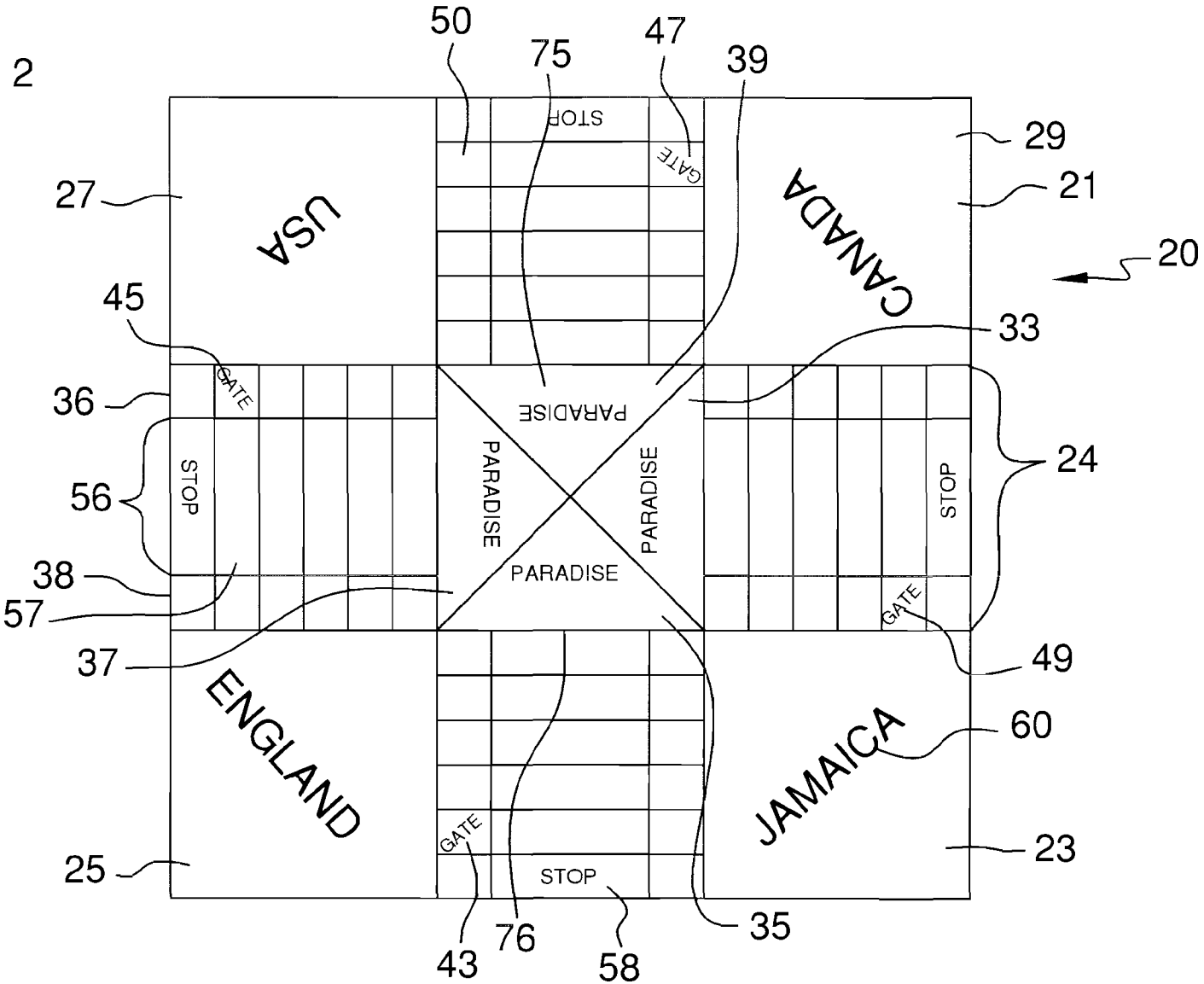
FIG. 2 is a top plan view of a game board.

With reference now to the drawings, and in particular FIGS. 1 through 4 thereof, example of the instant board game employing the principles and concepts of the present board game and generally designated by the reference number 10 will be described.

Referring to FIGS. 1 through 4, the present board game 10 comprises a pair of dice 70, a plurality of tokens 80, and a game board 20. Each of said cube-shaped die 70 has dots 73 on each face 71 of said die 70 representing a non-identical number from 1 through 6. Said tokens 80 are provided to each player in sets of four and each set differs from other players' sets by color, size, or shape, for example. Said game board 20 is made of cardboard or other suitable flat material. Said game board 20 comprises a substantially square planar playing surface on a front side 21 and on a rear side 22. Said front side 21 is divided into nine equal-sized squares comprising four home base spaces 23, 25, 27, and 29, each of which occupies a corner of said front side 21, a center square 75, and four square movement path areas 24, each movement path area 24 adjacent to and located between two home base spaces 23, 25, 27, and 29 as well as adjacent to and to the outside of said center square 75. A country name 60 selected from the group consisting of USA, Canada, Jamaica, and England, is imprinted in each home base space 23, 25, 27, 29. Each of said movement path areas 24 is in the form a grid comprising a home path 56 formed of six sequential rectangular home path spaces 57 bounded by six sequential square game spaces 50 on a left side 36 and six sequential square game spaces 50 on a right side 38 of said home path 56. An outermost home path rectangle 58 bears the indicia "STOP". One game space 50 adjacent to and to the left of each home space 23, 25, 27, 29 is a starting space 43, 45, 47, 49 bears the indicia "GATE". Said center square 75 is divided into four equilateral triangle-shaped finish spaces 33, 35, 37, 39, each bearing the indicia "PARADISE". A base 76 of each of said triangular finish spaces 33, 35, 37, 39 is a continuous line imprinted on said front side 21 to form said center square 75. Beginning with said starting space 43, 45, 47, 49 and ending with a corresponding finish space 33, 35, 37, 39, located to the left of each home base space 23, 25, 27, 29, respectively, forms a clockwise path of movement.

Figure 3:
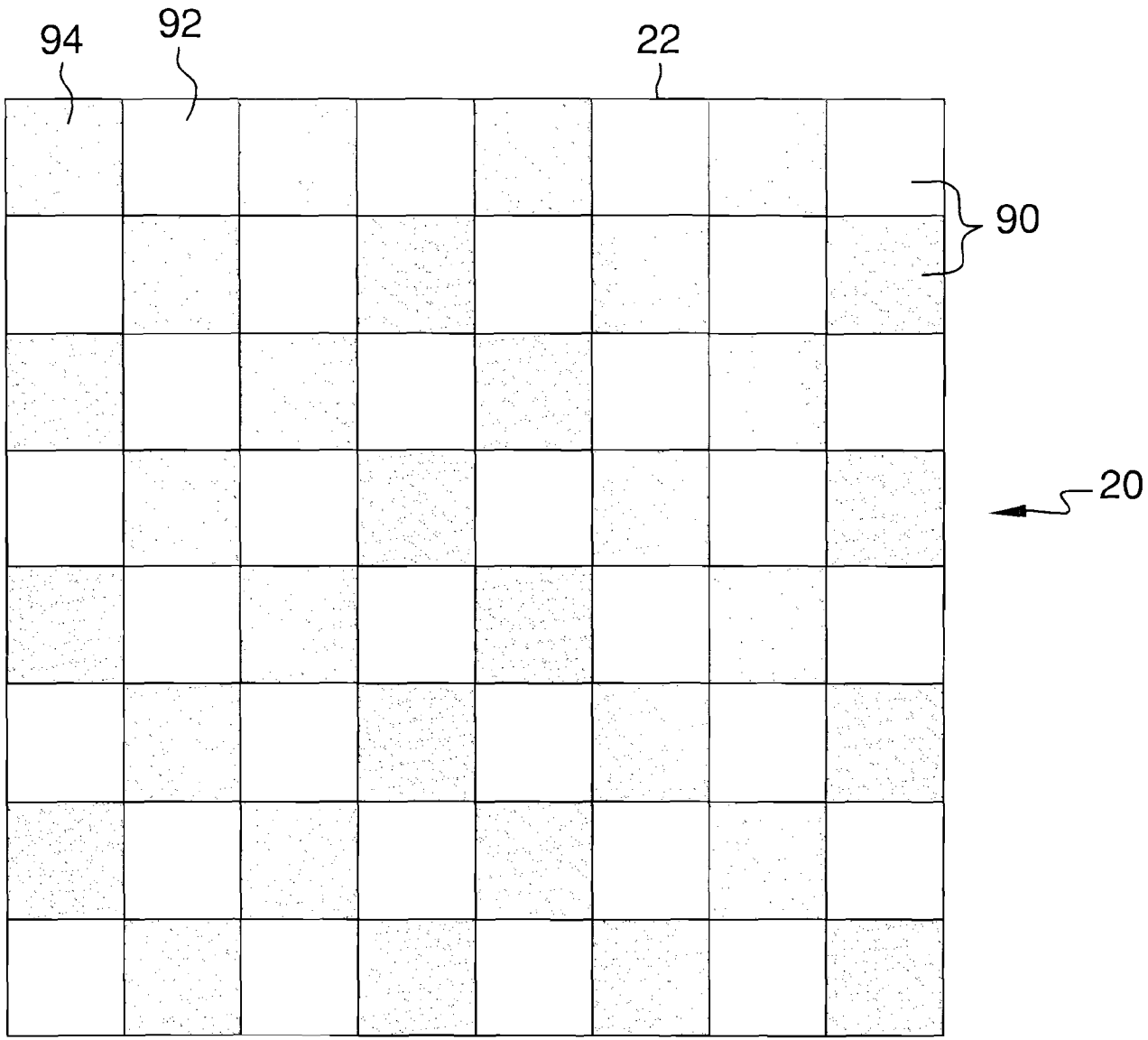
FIG. 3 is a bottom plan view.

As shown in FIG. 3, said rear side 22 of said game board 20 is divided into sixty-four equal-sized game squares 90. Said game squares 90 are divided into white squares 92 and marked squares 94, said marked squares 94 being of a certain color or having certain indicia to differentiate said marked squares 94 from said white squares 92. Said white squares 92 and said marked square 94 are alternated to form a checker-board design. Said rear side 22 may be used to play a game of checkers or other games created by players.

RULES

Each player places his or her tokens 80 on a home base space 23, 25, 27, 29. Each player casts the dice 70 and the player with the highest roll begins the game first by rolling the dice 70. A player may move a token 80 forward to his starting space 43, 45, 47, 49 only upon rolling a six on at least one die 70. If a player rolls a six on two dice 70, the player may move two tokens 80 forward to his starting space 43, 45, 47, 49 bearing the indicia "GATE". The next players roll the dice 70 in turn. After a player has a token in a starting space 43, 45, 47, 49, each time said player rolls the dice 70 he moves a token 80 forward, in a clockwise direction, the number of game spaces 50 equal to the throw of the dice 70. A single token 80 may be returned to a player's home base space 23, 25, 27, 29 if another player's token 80 lands on the same game space 50 previously occupied by the single token 80. Two of the same player's tokens 80 landing on the same game space 50 creates a blockade which may not be passed by another player's token 80. In this instance, the two tokens 80 are not returned to the home base space 23, 25, 27, 29. However, a player may forward his tokens 80 past a blockade such player created himself. When all of a player's tokens 80 are behind another player's blockade, such player may not advance any of his tokens 80 until the blockade is broken. When a player's token 80 initially enters such player's home path, such player must roll the exact count of dice to move such player's token onto such player's finish space 33, 35, 37, 39. The first player who places all four of such player's tokens 80 into such player's finish space 33, 35, 37, 39 is declared the winner of the game. After a first player is declared to be the winner, all remaining players may continue to play the game as desired to declare a second-place winner and a third-place winner.

Players may determine to play a game using only one die 70 if they determine to do so prior to beginning a game.

With respect to the above description then, it is to be realized that the optimum dimensional relationships for the parts of the present board game to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of playing a board game consisting of the steps of:

utilizing a pair of identical cube-shaped die having dots on each face, the dots representing a non-identical number from 1 through 6;

utilizing a plurality of tokens;

utilizing a game board comprising:

i) a square planar playing surface on a front side, said front side having nine equal-sized squares comprising:

four spaces representing home base spaces, each occupying a corner of said front side and bearing a country name;

a center square divided into four equilateral triangle-shaped spaces, each of said triangle-shaped spaces representing a finish space having a base forming a continuous line imprinted on said front side to form said center square; and four areas representing movement paths, each movement path area adjacent to and located between two home base spaces and as well as adjacent to and to the outside of said center square, each of said movement path areas in a grid form and comprising:

a home path formed of six sequential rectangular spaces bounded by six sequential square game spaces on a left side and six sequential square game spaces on a right side of said home path;

an outermost home path rectangular space;

a game space representing a starting space adjacent to and to the right of each of said home base space; and a clockwise path of movement beginning with a starting space and ending with a corresponding finish space;

and ii) a square planar playing surface on a rear side;

wherein said country name is selected from the group consisting of USA, Canada, Jamaica, and England;

wherein each of said finish space bears the indicia "PARADISE";

wherein each of said starting spaces bears the indicia "GATE";

wherein each of said outermost home path space bears the indicia "STOP";

wherein said tokens provided to each player in sets of four and each set differs from other players' sets by color, size, or shape;

wherein said rear side is divided into sixty-four equal-sized game squares, further divided into white squares and marked squares, said marked squares being of a certain color or having certain indicia to differentiate said marked squares from said white squares and being alternated to form a checker-board design;

placing said tokens on a home base space;

casting said die to determine the order of play;

moving one of said token forward to a player's starting space only upon rolling a pair of one die with six dots showing on one die face;

moving two of said tokens forward to a player's starting space only upon rolling said pair of die with six dots showing on the face of both die;

rolling said pair of die by each player in turn;

moving one of said tokens forward in a clockwise direction along said path of movement the number of game spaces equal to the throw of a said pair of dice after said token has been placed in said starting space;

returning one of said token to a player's home base space upon another player's token landing on the same game space;

creating a blockade which may not be passed by another player's token by landing two of the same player's tokens on the same game space;

retaining two of said tokens creating said blockade on a game space when another player throws a number of dots showing on the face of both die whereupon another player's token lands upon said blockade;

moving one of said tokens forwardly past a blockade by a player whose tokens created such blockade;

prohibiting advancement of other players' tokens which are located behind a player's blockade, until such blockade is broken;

requiring an exact count of die to move a token onto a player's finish space after such player's token initially enters a player's home path; and declaring as winner the first player who places all tokens belonging to such player's tokens into such player's finish space.

* * * * *